US006701978B1

(12) United States Patent
Buchanan

(10) Patent No.: US 6,701,978 B1
(45) Date of Patent: Mar. 9, 2004

(54) EASY CHANGE OIL SYSTEM

(75) Inventor: William Thomas Buchanan, Murchison, TX (US)

(73) Assignee: W. T. Buchanan, Murchison, TX (US)

( * ) Notice: Subject to any disclaimer, the term of this patent is extended or adjusted under 35 U.S.C. 154(b) by 9 days.

(21) Appl. No.: 10/286,996

(22) Filed: Nov. 4, 2002

(51) Int. Cl.[7] ..... B65B 1/04; B65B 3/04; B67C 3/02

(52) U.S. Cl. ..... 141/86; 141/313; 141/384; 440/88 R; 184/1.5

(58) Field of Search ..... 141/86, 114, 313–317, 141/383–386; 184/1.5; 440/88 R, 88 L

(56) References Cited

U.S. PATENT DOCUMENTS 3,874,478 A * 4/1975 Mantell, Jr. ..... 184/1.5
4,033,432 A * 7/1977 Bernstein ..... 184/1.5
4,756,349 A * 7/1988 Atkins ..... 141/383
5,199,914 A * 4/1993 Marsh ..... 440/88

* cited by examiner

*Primary Examiner*—Timothy L. Maust

(57) ABSTRACT

Easy Change Oil System is a unit composed of a disposable plastic bag, jug or bottle adapted to screw directly into the oil drain aperture of fourstroke outboard engines, and/or other small fourstroke engines. The system has a threaded cap or closure to seal the container. The system differs from all previous patents, see cross reference, in that it is threaded, screws directly into the oil drain aperture, is one unit, completely disposable, and requires no additional valves, or nozzles.

1 Claim, 1 Drawing Sheet

The System Installed

The System

The System Installed

EASY CHANGE OIL SYSTEM

CROSS REFERENCE TO RELATED APPLICATIONS

| No. | Date | Inventor |
|---|---|---|
| 5,199,914 | Apr. 6, 1993 | Marsh |

BACKGROUND OF THE INVENTION

Four stroke engines are more environmentally safe, fuel efficient, quiet and dependable than the older two stroke engines.

At the first oil change, normally after ten hours of use, the new owner finds it almost impossible to change the oil unless the boat is removed from the water.

The Easy Change Oil System permits a clean, environmentally safe, method to change the oil even with the boat remaining in the water.

BRIEF SUMMARY OF THE INVENTION

The Easy Change Oil System is a system composed of a plastic container with a threaded barb that screws directly into an oil drain. The system is to be primarily used on four stroke outboard motors but may be utilized on other internal combustion engines. The system may be manufactured out of plastic bags, bottles or jugs and has a cap to seal the container. The disposal bag may be coupled with a plastic container containing the new oil.

DETAILED DESCRIPTION

This disclosure of the invention is submitted in furtherance of the constitutional purposes of the Patent Laws "to promote the progress of science and useful arts" (Article 1, Section 8).

Outboard four cycle motors are manufactured by several different companies around the world. Each model varies somewhat from one to another, but all usually includes a drain plug mounted at a position on the motor so that oil may be drained by gravity from the crankcase to facilitate periodic maintenance.

Figure 1:
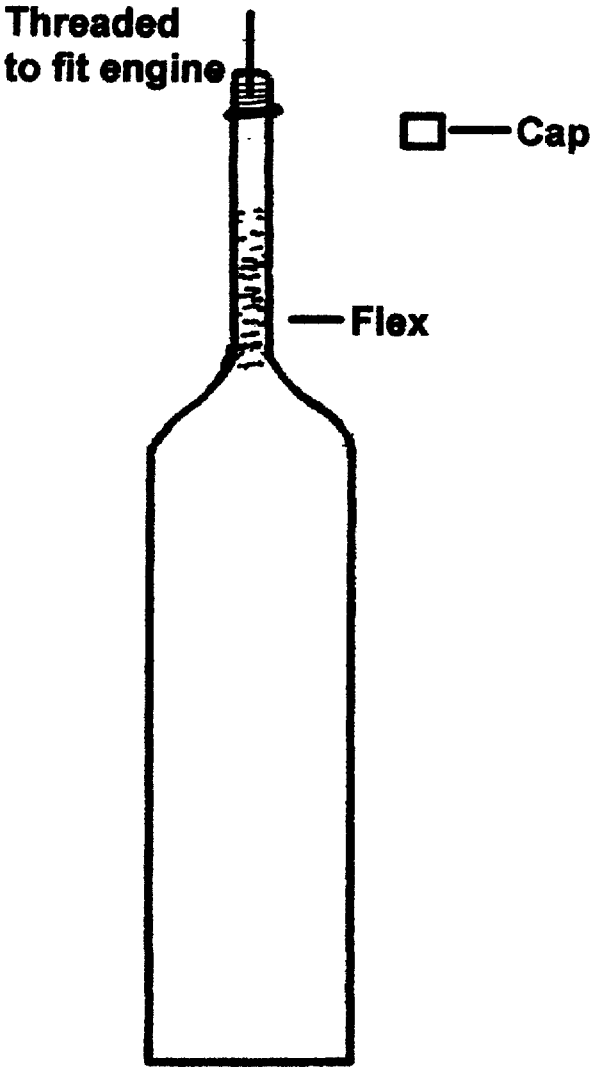
FIG. 1 shows the complete system including the cap for closure.

The Easy Change System is shown in the drawing (FIG. 1). The system provides to facilitate fast, simple and clean drainage of oil from four cycle outboard motors without the hazard of the oil running down the drive shaft housing, or spilling into or onto the adjacent water or ground surface below. This may be done quickly and easily regardless of the location of the engine.

Figure 2:
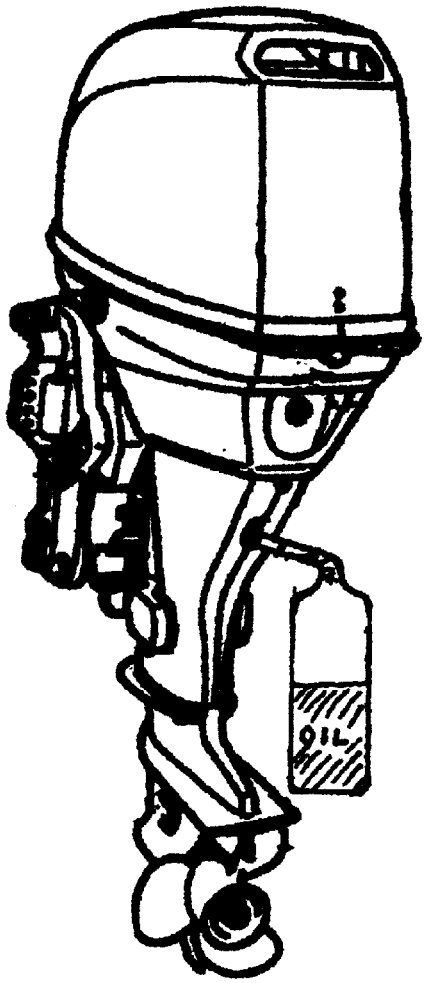
FIG. 2 shows the use of the system on a typical four stroke outboard engine.

In the outboard in FIG. 2, the crankcase drain plug is mounted to the drive shaft housing. The upper portions of the drive shaft housing enclose portions of the motor crankcase. The drain plug is typically threaded into a crankcase drain opening of the engine. Removal of the drain plug allows the oil to drain by gravity from the crankcase.

Operation is as follows. The engine is raised to its utmost up position. The drain plug is removed. The system is screwed into the drain plug. The engine is lowered to a level position. The oil drains into the disposal bag (FIG. 2). The engine is raised slightly to allow easy removal of the barb without spilling the oil. The system is unscrewed from the drain. The cap is placed on the drain system to eliminate oil spillage. The motor is raised to utmost up position.

The drain plug is reinstalled. The motor is lowered to the level position. The new oil is poured into the fill opening. The new oil may be in an attached portion of the system or in separate packages. The used oil and containers are disposed of in an environmentally safe manner.

The system is intended to be marketed separately or with new oil in a kit.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

What is claimed is:

1. An oil change apparatus for use with fourstroke outboard engines and other small fourstroke engines, said oil change apparatus comprising: a flexible, disposable container consisting of a valveless, externally threaded opening adapted to thread directly into internal threads of a crankcase oil drain opening on said fourstroke engines and capture oil drained therefrom; wherein said externally threaded opening further includes a threaded cap or closure to close and seal said disposable container.

* * * * *